US009988227B2

(12) United States Patent
Kumagai

(10) Patent No.: US 9,988,227 B2
(45) Date of Patent: Jun. 5, 2018

(54) SHEET CONVEYING APPARATUS AND IMAGE FORMING APPARATUS

(71) Applicant: CANON KABUSHIKI KAISHA, Tokyo (JP)

(72) Inventor: Shigemi Kumagai, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/479,175

(22) Filed: Apr. 4, 2017

(65) Prior Publication Data

US 2017/0291783 A1 Oct. 12, 2017

(30) Foreign Application Priority Data

Apr. 8, 2016 (JP) ..... 2016-078268

(51) Int. Cl.
*B65H 9/00* (2006.01)

(52) U.S. Cl.
CPC ..... *B65H 9/006* (2013.01); *B65H 2511/212* (2013.01); *B65H 2515/704* (2013.01)

(58) Field of Classification Search
CPC .. B65H 9/006; B65H 9/004; B65H 2511/212; B65H 2515/704
See application file for complete search history.

(56) References Cited

FOREIGN PATENT DOCUMENTS

| | | | |
|---|---|---|---|
| JP | 2003-221161 | A | 8/2003 |
| JP | 2003-252485 | A | 9/2003 |
| JP | 2004-320847 | A | 11/2004 |
| JP | 2005-039955 | A | 2/2005 |
| JP | 2008-278595 | A | 11/2008 |
| JP | 2009-203069 | A | 9/2009 |
| JP | 2010-030723 | A | 2/2010 |
| JP | 2015-157681 | A | 9/2015 |
| JP | 2016-005422 | A | 1/2016 |

*Primary Examiner* — Michael C McCullough
(74) *Attorney, Agent, or Firm* — Canon U.S.A., Inc. IP Division

(57) ABSTRACT

A sheet conveying apparatus includes an abutment member against which a leading end of a sheet conveyed by a conveying roller abuts, a phase determiner that determines a rotation phase of a rotor of a motor driving the conveying roller, a controller that controls the motor by controlling the value of a torque current component and the value of an excitation current component so that a difference between an instruction phase and the rotation phase is decreased, and a torque determiner that determines load torque exerted on the rotor. The controller continues driving of the motor if the load torque is lower than predetermined torque in a state in which the leading end of the sheet abuts against the abutment member to deflect the sheet and stops the driving of the motor if the load torque is higher than or equal to the predetermined torque.

11 Claims, 8 Drawing Sheets

SHEET CONVEYING APPARATUS AND IMAGE FORMING APPARATUS

BACKGROUND OF THE INVENTION

Field of the Invention

The present disclosure relates to a sheet conveying apparatus and an image forming apparatus that perform skew correction of a sheet.

Description of the Related Art

Methods have hitherto been known in an image forming apparatus, in which skew on a side at the leading end side of a recording medium is corrected so that a toner image formed on the surface of a photoconductive drum transferred to a predetermined position on the recording medium. In skew correction described in Japanese Patent Laid-Open No. 2003-252485, registration rollers and pre-registration rollers are used. The pre-registration rollers are provided at the upstream side of the registration rollers in a direction in which a recording medium is conveyed. Also, a sheet sensor that detects the leading end of the recording medium is provided between the registration rollers and the pre-registration rollers on a conveying path of the recording medium. After the sheet sensor has detected the leading end of the recording medium, the pre-registration rollers rotate for a predetermined time. As a result, the leading end of the recording medium abuts against a nip portion of the registration rollers that are stopped and the recording medium deflects, thus the skew of the recording medium is corrected.

However, the pre-registration rollers may deteriorate due to, for example, abrasion or stain with aging of the image forming apparatus. Accordingly, the amount of the feed of the recording medium by the pre-registration rollers in the conveying direction may be made smaller than that before the deterioration of the pre-registration rollers. In this case, even if the recording medium deflects because of the rotation of the pre-registration rollers for a predetermined time after the sheet sensor has detected the leading end of the recording medium, the amount of deflection of the recording medium may be insufficient for appropriate skew correction of the recording medium. As a result, the skew correction of the recording medium may not be appropriately performed.

In order to resolve the above issues, it is desirable to control a motor based on load torque exerted on a rotor of the motor that drives conveying rollers in a state in which the leading end of a sheet abuts against an abutment member to deflect the sheet.

SUMMARY OF THE INVENTION

The present disclosure provides a sheet conveying apparatus including a conveying roller that conveys a sheet, an abutment member against which the leading end of the sheet conveyed by the conveying roller abuts, the abutment member being provided at a downstream side of the conveying roller in a conveying direction in which the sheet is conveyed, a motor that drives the conveying roller, a phase determiner that determines a rotation phase of a rotor of the motor, a controller that controls the motor by controlling the value of a torque current component and the value of an excitation current component so that the difference between an instruction phase representing a target phase of the rotor and the rotation phase determined by the phase determiner is decreased, and a torque determiner that determines load torque exerted on the rotor. The torque current component is a current component having a current value represented in a rotating coordinate system based on the rotation phase, which generates torque in the rotor, and the excitation current component is a current component having a current, value represented in the rotating coordinate system based on the rotation phase, which affects the strength of a magnetic flux through a winding of the motor. The controller continues driving of the motor if the load torque determined by the torque determiner is lower than predetermined torque when the conveying roller conveys the sheet in a state in which the leading end of the sheet abuts against the abutment member to deflect the sheet and stops the driving of the motor if the load torque determined by the torque determiner is higher than or equal to the predetermined torque when the conveying roller conveys the sheet in a state in which the leading end of the sheet abuts against the abutment member to deflect the sheet.

Further features of the present disclosure will become apparent from the following description of exemplary embodiments with reference to the attached drawings.

DESCRIPTION OF THE EMBODIMENTS

Embodiments of the present disclosure will herein be described with reference to the attached drawings. The shapes of components described in the embodiments, the relative arrangement of the components, and so on should be appropriately modified in accordance with the configuration of an apparatus to which the present disclosure is applied and various conditions and the scope and spirit of the present disclosure are not limited to the following embodiments. Although a case is described in the following description in which a motor control apparatus is provided in an image forming apparatus, the motor control apparatus may not necessarily be provided in an image forming apparatus. For example, the motor control apparatus may also be used in a sheet conveying apparatus that conveys a sheet, such as a recording medium or an original document.

First Embodiment

[Image Forming Apparatus]

Figure 1:
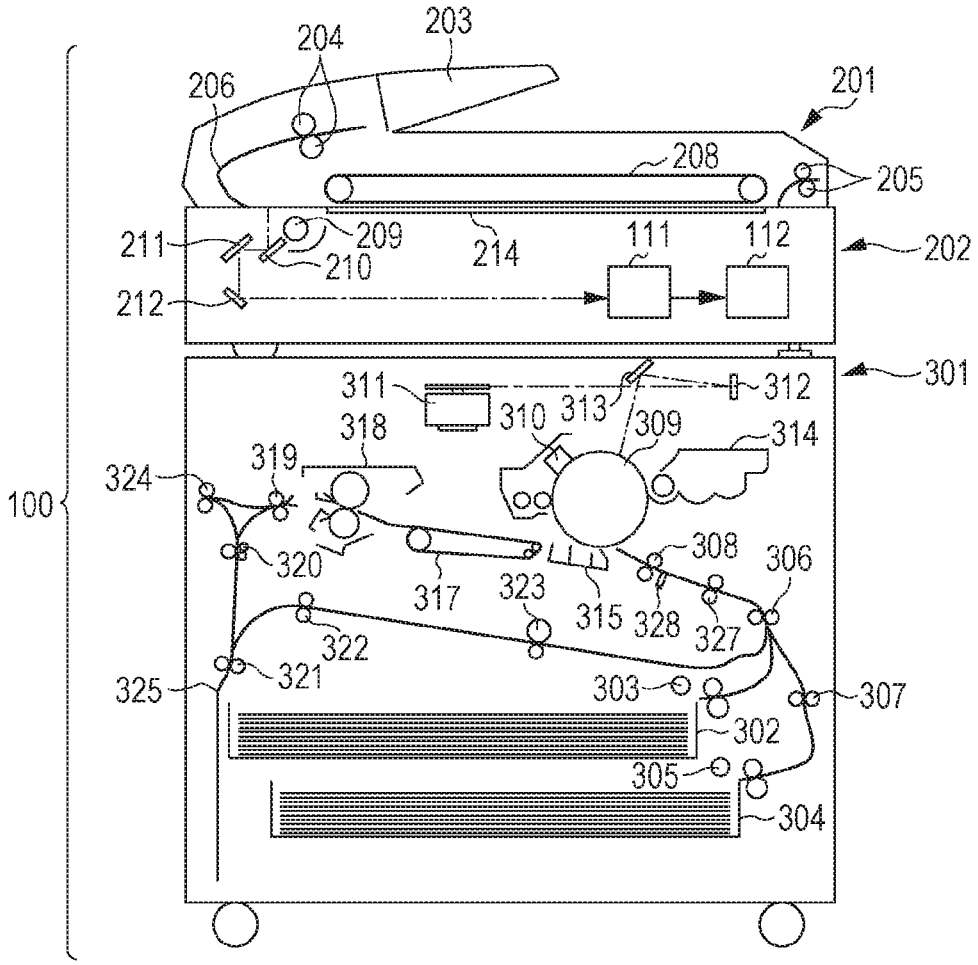
FIG. 1 is a cross-sectional view illustrating an exemplary configuration of an image forming apparatus according to a first embodiment.

FIG. 1 is a cross-sectional view illustrating an exemplary configuration of an electrophotographic monochrome copy machine (hereinafter referred to as an image forming apparatus) 100 including a sheet conveying apparatus used in a first embodiment. The image forming apparatus is not limited to the copy machine and may be, for example, a facsimile apparatus, a printing machine, or a printer. The recording method is not limited to the electrophotographic method and may be, for example, an inkjet method. The image forming apparatus may be of the monochrome type or a color type.

The configuration and the function of the image forming apparatus 100 will now be described with reference to FIG. 1. The image forming apparatus 100 includes a document feeding unit 201, a reading unit 202, and a main body 301 of the image forming apparatus.

An original document stacked in a document loader 203 in the document feeding unit 201 is fed by feed rollers 204 one by one and is conveyed to a glass platen 214 in the reading unit 202 along a conveying guide 206. In addition, the original document is conveyed at a constant speed along a conveying belt 208 and is discharged to a discharge tray (not illustrated) by discharge rollers 205. Light reflected from the original document illuminated with an illumination system 209 at a reading position of the reading unit 202 is led to an image reader 111 via an optical system including reflection mirrors 210, 211, and 212 and is converted into an image signal by the image reader 111. The image reader 111 is composed of, for example, a lens, a charge couplets device (CCD), which is a photoelectric conversion device, and a driving circuit for the CCD. The image signal output from the image reader 111 is subjected to various correction processes in an image processor 272 composed of a hardware device, such as an application specific integrated circuit (ASIC), and is supplied to the main body 301 of the image forming apparatus. Reading of the original document is performed in the above manner. In other words, the document feeding unit 201 and the reading unit 202 function as a document reading apparatus.

The original document is read in two reading modes: a first reading mode and a second reading mode. In the first reading mode, an image of the original document conveyed at a constant speed is captured with the illumination system 209 and the optical system, which are fixed at certain positions. In the second reading mode, an image of the original document displaced on the glass platen 214 in the reading unit 202 is captured with the illumination system 209 and the optical system, which move at a constant speed. An image of a sheet-type original document is normally read in the first reading mode and an image of a bound original document, such as a book or a booklet, is normally read in the second reading mode.

Sheet storage trays 302 and 304 are provided in the main body 301 of the image forming apparatus. Recording media of different kinds may be stored in the sheet storage trays 302 and 304. For example, A4-size sheets of plain paper are stored in the sheet storage tray 302 and A4-size sheets of thick paper are stored in the sheet storage tray 304. An image is formed on the recording medium by the image forming apparatus. The recording medium is, for example, a sheet of paper, a resin sheet, a cloth, an overhead projector (OHP) sheet, or a label.

Each recording medium stored in the sheet storage tray 302 is fed by a feed roller 303 and is supplied to registration rollers 308 by conveying rollers 306 and pre-registration rollers 327. Each recording medium stored in the sheet storage tray 304 is fed by a feed roller 305 and is supplied to the registration rollers 308 by conveying rollers 307, the conveying rollers 306, and the pre-registration rollers 327.

As illustrated in FIG. 1, a sheet sensor 328 that detect the leading end of the recording medium is provided between the pre-registration rollers 327 and the registration rollers 308. The image forming apparatus 100 corrects skew of the recording medium using a method described below with the pre-registration rollers 327, the registration rollers 308, and the sheet sensor 328. The pre-registration rollers 327 in the first embodiment correspond to a conveying roller. The registration rollers 308 in the first embodiment correspond to an abutment member and a second conveying roller.

The image signal output from the reading unit 202 is input into an optical scanning unit 311 including a semiconductor laser and a polygon mirror. The outer peripheral surface of a photoconductive drum 309 is charged with a charger 310. After the outer peripheral surface of the photoconductive drum 309 is charged, the outer peripheral surface of the photoconductive drum. 309 is irradiated with laser light which corresponds to the image signal supplied from the reading unit 202 to the optical scanning unit 311 and which is emitted from the optical scanning unit 311 to the outer peripheral surface of the photoconductive drum 309 via the polygon mirror and mirrors 312 and 313. As a result, an electrostatic latent image is formed on the outer peripheral surface of the photoconductive drum 309. A charging method using, for example, a corona charger or charging rollers is used to charge the photoconductive drum.

Then, the electrostatic latent image is developed with toner in a developer unit 314 and a toner image is formed on the outer peripheral surface of the photoconductive drum 309. The toner image formed on the photoconductive drum 309 is transferred to the recording medium with a transfer charger 315 provided at a position (transfer position) opposing the photoconductive drum 309. At this time, the recording medium is fed to the transfer position in time with the toner image by the registration rollers 308.

The recording medium on which the toner image is transferred in the above manner is fed to a fixing unit 313 along a conveying belt 317 and is subjected to application of heat and pressure in the fixing unit 318 to fix the toner image on the recording medium. An image is formed on the recording medium by the image forming apparatus 100 in the above manner.

In the image formation in one-side printing, the recording medium that has passed through the fixing unit 318 is discharged to the discharge tray (not illustrated) by discharge rollers 319 and 324. In the image formation in duplex printing, a first side of the recording medium is subjected to a fixing process with the fixing unit. 318 and the recording medium is conveyed to a reversing path 325 by the discharge rollers 319, conveying rollers 320, and reversing rollers 321. Then, the recording medium is conveyed again to the registration rollers 308 by conveying rollers 322 and 323 and an image is formed on a second side of the recording medium using the method described above. Then, the recording medium is discharged to the discharge tray (not illustrated) by the discharge rollers 319 and 324.

When the recording medium having an image formed on its first side is to be discharged to the outside of the image forming apparatus 100 in a face-down state, the recording medium that has passed through the fixing unit 318 is conveyed in a direction toward the conveying rollers 320 via the discharge rollers 319. Then, the rotation of the conveying rollers 320 is reversed immediately before the posterior end of the recording medium passes through a nip portion of the conveying rollers 320 and the recording medium is discharged to the outside of the image forming apparatus 100 via the discharge roller 324 in a state in which the first side of the recording medium is faced down.

The configuration and the function of the image forming apparatus 100 have been described above.

Figure 2:
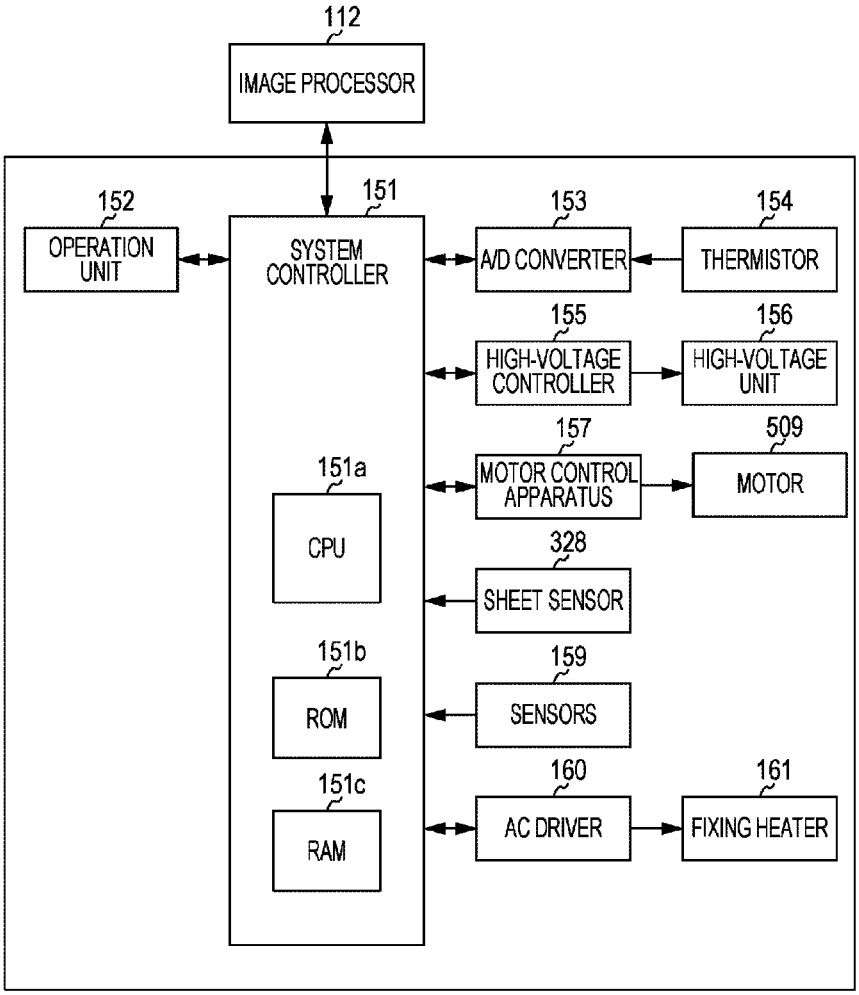
FIG. 2 is a block diagram illustrating an exemplary control configuration of the image forming apparatus.

FIG. 2 is a block diagram illustrating an exemplary control configuration of the image forming apparatus 100. Referring to FIG. 2, a system controller 151 includes a central processing unit (CPU) 151*a*, a read only memory (ROM) 151*b*, and a random access memory (PAN) 151*c*. The system controller 151 is connected to an image processor 112, an operation unit 152, an analog-to-digital (A/D) converter 153, a high-voltage controller 155, a motor control apparatus 157, the sheet sensor 328, sensors 159, and an alternating-current (AC) driver 160. The system controller 151 is capable of transmitting and receiving data and commands to and from the units connected to the system controller 151.

The CPU 151*a* reads out various programs stored in the ROM 151*h* and executes the programs to perform various sequences related to a predetermined image forming sequence.

The RAM 151*c* is a storage device. A variety of data including a setting value for the high-voltage controller 155, an instruction value for the motor control apparatus 157, and information received from the operation unit 152 is stored in the RAN 151*c*.

The system controller 151 transmits setting value data for the various units provided in the image forming apparatus 100 to the image processor 112. The setting value data is necessary for the image processing in the image processor 112 in addition, the system controller 151 receives signals from the various units (for example, signals from the sensors 159) and sets the setting value for the high-voltage controller 155 based on the received signals. The high-voltage controller 155 supplies voltage necessary for a high-voltage unit 156 (the charger 310, the developer unit 314, the transfer charger 315, and so on) in accordance with the setting value set by the system controller 151.

The CPU 151*a* controls the motor control apparatus 157 based on a signal supplied from the sheet sensor 328. The motor control apparatus 157 controls a motor 509 in accordance with an instruction supplied from the CPU 151*a*. Although only the motor 509 is illustrated as a motor in the image forming apparatus in FIG. 2, multiple motors are practically provided in the image forming apparatus. A configuration may be used in which one motor control apparatus controls the multiple motors. Although only one motor control apparatus is provided in the image forming apparatus in FIG. 2, multiple motor control apparatuses are practically provided in the image forming apparatus.

The A/D converter 153 receives a detection signal detected by a thermistor 154 for detecting the temperature of a fixing heater 161, converts the detection signal from an analog signal to a digital signal, and supplies the digital signal to the system controller 151. The system controller 151 controls the AC driver 160 based on the digital signal received from the A/D converter 153. The AC driver 160 controls the fixing heater 161 so that the fixing heater 161 has a temperature necessary to perform the fixing process. The fixing heater 161 is a heater used for the fixing process and is included in the fixing unit 318.

The system controller 151 controls the operation unit 152 so that an operation screen used by a user to set, for example, the type of the recording medium that is used (hereinafter referred to as a sheet type) is displayed in a display provided in the operation unit 152. The system controller 151 receives information set by the user from the operation unit. 152 and controls an operational sequence of the image forming apparatus 100 based on the information set by the user. The system controller 151 transmits information indicating the state of the image forming apparatus to the operation unit 152. The information indicating the state of the image forming apparatus is information indicating, for example, the number of images to be formed, whether the image formation is being performed, whether a jam has occurred, and where the jam has occurred. The operation unit 152 displays the information received from the system controller 151 in the display.

The system controller 151 controls the operational sequence of the image forming apparatus 100 in the above manner.

[Vector Control]

The motor control apparatus in the first embodiment will now be described. The motor control apparatus in the first embodiment controls the motor using vector control. Although the motor in the first embodiment does not include a sensor, such as a rotary encoder, for detecting a rotation phase of the rotor of the motor, the motor may include a sensor, such as a rotary encoder.

How the motor control apparatus 157 in the first embodiment performs the vector control will now be described with reference to FIG. 3 and FIG. 4.

Figure 3:
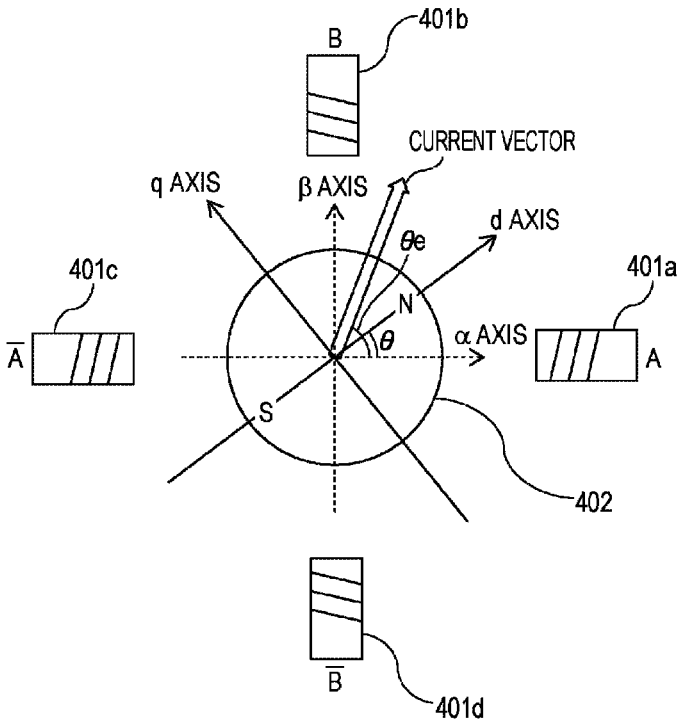
FIG. 3 is a diagram illustrating the relationship between a two-phase motor having an. A phase and a B phase and a d axis and a q axis in a rotating coordinate system.

FIG. 3 is a diagram illustrating the relationship between the stepping motor (hereinafter referred to as the motor) 509 having two phases: an A phase (first phase) and a B phase (second phase) and a rotating coordinate system represented by a d axis and a q axis. Referring to FIG. 3, an $\alpha$ axis corresponding to the winding of the A phase and a $\beta$ axis corresponding to the winding of the B phase are defined in a stationary coordinate system. The d axis is defined along the direction of a magnetic flux formed by a magnetic pole of a permanent magnet used for a rotor 402 and the q axis is defined along a direction proceeding counterclockwise from the d axis by 90 degrees (direction orthogonal to the d axis) in FIG. 3. The angle formed by the $\alpha$ axis and the d axis is defined as $\theta$ and the rotation phase of the rotor 402 is represented by the angle $\theta$. In the vector control, the rotating coordinate system based on the rotation phase $\theta$ of the rotor 402 is used. Specifically, in the vector control, the value of a q-axis component (torque current component) to generate torque in the rotor and the value of a d-axis component (excitation current component) affecting the strength of a magnetic flux through the windings are used. The q-axis component (torque current component) and the d-axis component (excitation current component) are current components of current vector corresponding to driving current flowing through the windings in the rotating coordinate system.

The vector control is a control method of performing phase feedback control to control the motor in the phase feedback control, the value of the torque current component and the value of the excitation current component are controlled so that the difference between an instruction phase indicating a target phase of the rotor and an actual rotation phase is decreased.

Figure 4:
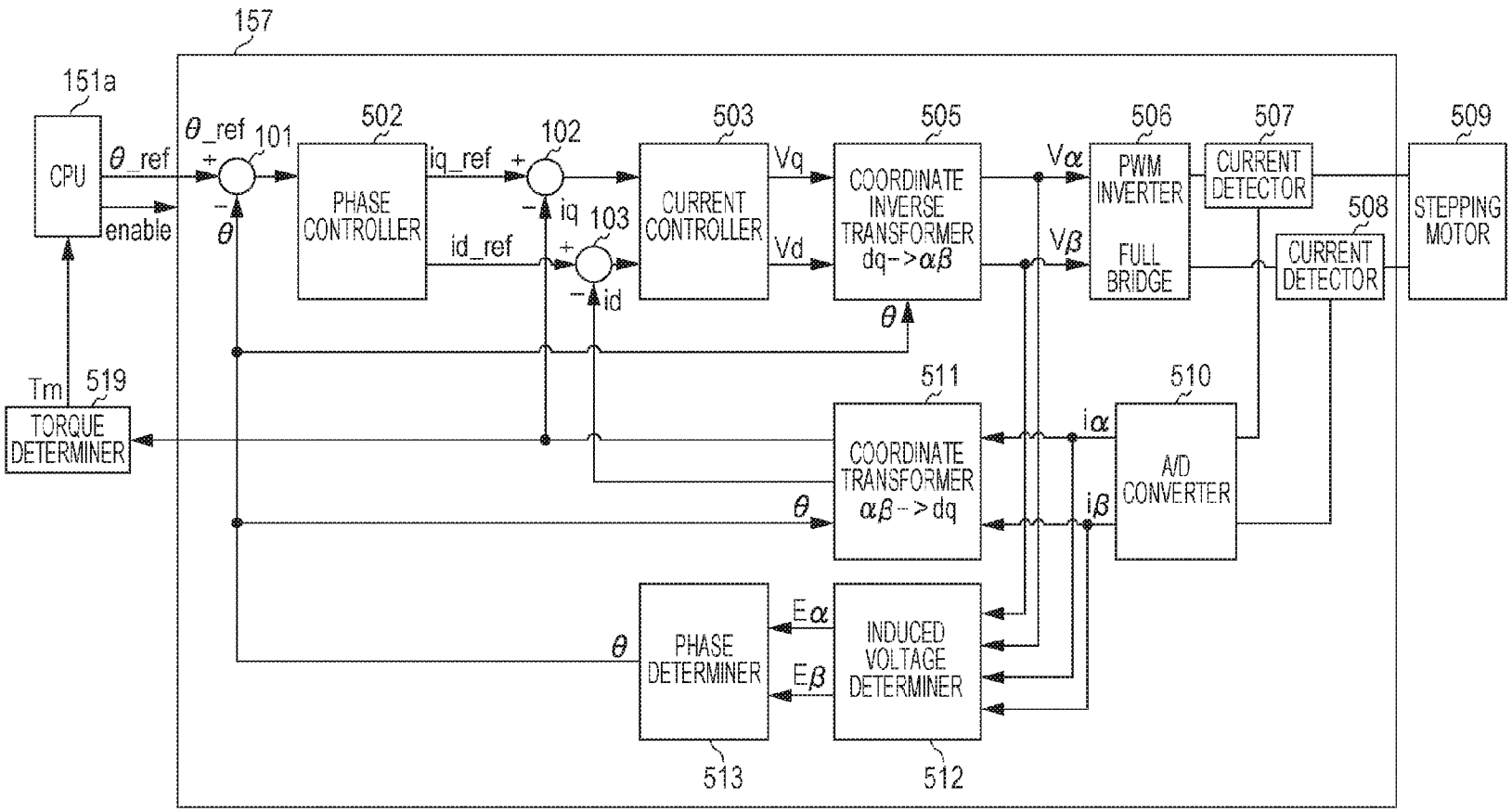
FIG. 4 is a block diagram illustrating an exemplary configuration of a motor control apparatus according to the first embodiment.

FIG. 4 is a block diagram illustrating an exemplary configuration of the motor control apparatus 157 controlling the motor 509.

Referring to FIG. 4, the motor control apparatus 157 includes, for example, a phase controller 502, a current controller 503, a coordinate inverse transformer 505, a coordinate transformer 511, and a pulse width modulation (PWM) inverter 506 that supplies the driving' current to the windings of the motor, as a circuit for the vector control. The coordinate transformer 511 performs coordinate conversion of the current vector corresponding to the driving current flowing through the windings of the A phase and the B phase of the motor 509 from the stationary coordinate system represented by the α axis and the β axis to the rotating coordinate system represented by the q axis and the d axis. As a result, the driving current flowing through the windings is represented by the current value of the q-axis component (q-axis current) and the current value of the d-axis component (d-axis current), which are the current values in the rotating coordinate system. The q-axis current corresponds to torque current to generate torque in the rotor 402 of the motor 509. The d-axis current corresponds to excitation current affecting the strength of the magnetic flux through the windings of the motor 509 and does not contribute to the generation of torque in the rotor 402. The motor control apparatus 157 is capable of independently controlling the q-axis current and the d-axis current. As a result, the motor control apparatus 157 is capable of efficiently generating the torque necessary to rotate the rotor 402 by controlling the q-axis current in accordance with load torque exerted on the rotor.

The motor control apparatus 157 determines the rotation phase θ of the rotor 402 of the motor 509 using a method described below and performs the vector control based on the result of the determination. The CPU 151*a* generates an instruction phase θ_ref indicating the target phase of the rotor 402 of the motor 509 and supplies the generated instruction phase θ_ref to the motor control apparatus 157 with a predetermined time period.

A subtractor 101 calculates the difference between the rotation phase θ and the instruction phase θ_ref of the rotor 402 of the motor 509 and supplies the calculated difference to the phase controller 502.

The phase controller 502 generates a q-axis current instruction value iq_ref and a d-axis current instruction value id_ref so that the difference supplied from the subtractor 101 is decreased based on proportional control (P), integral control (I), and differential control (D) and outputs the generated q-axis current instruction value iq_ref and d-axis current instruction value id_ref. Specifically, the phase controller 502 generates the q-axis current instruction value iq_ref and the d-axis current instruction value id_ref so that the difference supplied from the subtractor 101 is equal to zero based on the P control, the I control, and the D control and outputs the generated q-axis current instruction value iq_ref and d-axis current instruction value id_ref. The P control is a control method of controlling the value of a target to be controlled based on a value proportional to the difference between the instruction value and an estimated value. The I control is a control method of controlling the value of a target to be controlled based on a value proportional to time integral of the difference between the instruction value and the estimated value. The D control is a control method of controlling the value of a target to be controlled based on a value proportional to variation in time of the difference between the instruction value and the estimated value. Although the phase controller 502 in the first embodiment generates the q-axis current instruction value iq_ref and the d-axis current instruction value id_ref based on the PID control, the generation of the q-axis current instruction value iq_ref and the d-axis current, instruction value id_ref is not limitedly based on the PID control. For example, the phase controller 502 may generate the q-axis current instruction value iq_ref and the d-axis current instruction value id_ref based on PI control. Although the d-axis current instruction value id_ref affecting the strength of the magnetic flux through the windings is normally set to zero when a permanent magnet is used for the rotor 402, the value of the d-axis current instruction value id_ref is not limited to zero.

The driving current flowing through the windings of the A phase and the B phase of the motor 509 is detected with current detectors 507 and 508 and, then, is converted from an analog value to a digital value by an A/D converter 510.

The current value of the driving current, which is converted from an analog value to a digital value by the A/D converter 510, is represented as current values iα, and iβ in the stationary coordinate system according to Equations (1) and (2) using a phase θe of the current, vector illustrated in FIG. 3. The phase θe of the current vector is defined as an angle formed by the α axis and the current vector. In Equations (1) and (2), denotes the magnitude of the current vector.

$$i\alpha = I^* \cos \theta e \tag{1}$$

$$i\beta I^* \sin \theta e \tag{2}$$

The current values iα and iβ are supplied to the coordinate transformer 511 and an induced voltage determiner 512.

The coordinate transformer 511 performs the coordinate conversion of the current values iα and iβ into a d-axis current value id and a q-axis current value iq in the rotating coordinate system according to Equations (3) and (4):

$$id = \cos \theta^* i\alpha + \sin \theta^* i\beta \tag{3}$$

$$iq = -\sin \theta^* i\alpha + \cos \theta^* i\beta \tag{4}$$

The current value iq converted by the coordinate transformer 511 is supplied to a subtractor 102 and a torque determiner 519. The current value id converted by the coordinate transformer 511 is supplied to a subtractor 103. The torque determiner 519 will be described below.

The subtractor 102 calculates the difference between the q-axis current instruction value iq_ref supplied from the phase controller 502 and the current value iq supplied from the coordinate transformer 511 and supplies the calculated difference to the current controller 503.

The subtractor 103 calculates the difference between the d-axis current instruction value id_ref supplied from the phase controller 502 and the current value id supplied from the coordinate transformer 511 and supplies the calculated difference to the current controller 503.

The current controller 503 generates driving voltage Vq and driving voltage Vd so that the respective differences are decreased based on the PID control. Specifically, the current controller 503 generates the driving voltage Vq and the driving voltage Vd so that the differences are decreased to zero and supplies the generated driving voltage Vq and driving voltage Vd to the coordinate inverse transformer 505. In other words, the current controller 503 functions as a generator. Although the current controller 503 in the first embodiment generates the driving voltage Vq and the driving voltage Vd based on the PID control, the generation of the driving voltage Vq and the driving voltage Vd is not limitedly based on the PID control. For example, the current controller 503 may generate the driving voltage Vq and the driving voltage Vd based on the PI control.

The coordinate inverse transformer 505 performs inverse transform of the driving voltage Vq and the driving voltage Vd in the rotating coordinate system, which are supplied from the current controller 503, into driving voltage Vα and driving voltage Vβ in the stationary coordinate system according to Equations (5) and (6):

$$V\alpha = con\theta * Vd - \sin\theta * Vq \quad (5)$$

$$V\beta = \sin\theta * Vd + \cos\theta * Vq \quad (6)$$

After the inverse transform of the driving voltage Vq and the driving voltage Vd in the rotating coordinate system into the driving voltage Vu and the driving voltage Vβ in the stationary coordinate system, the coordinate inverse transformer 505 supplies the driving voltage Vα and the driving voltage Vβ to the PWM inverter 506 and the induced voltage determiner 512.

The PWM inverter 506 includes a full-bridge circuit. The full-bridge circuit is driven with a PWM signal based on the driving voltage Vα and the driving voltage Vβ supplied from the coordinate inverse transformer 505. As a result, the PWM inverter 506 generates driving current iα and driving current iβ corresponding to the driving voltage Vα and the driving voltage Vβ, respectively, and supplies the driving current iα and the driving current iβ to the windings of the respective phases of the motor 509 to drive the motor 509. In other words, the PWM inverter 506 functions as a current provider that supplies the current to the winding of each phase of the motor 509. Although the PWM inverter includes the full-bridge circuit in the first embodiment, the PWM inverter may include a half-bridge circuit or the like.

How to determine the rotation phase θ of the rotor will now be described. The values of induced voltage Eα and induced voltage Eβ induced in the windings of the A phase and the B phase, respectively, of the motor 509 in response to the rotation of the rotor 402 are used to determine the rotation phase θ of the rotor. The values of the induced voltages are determined (calculated) by the induced voltage determiner 512. Specifically, the induced voltages Eα and Eβ are determined from the current values iα and iβ supplied from the A/D converter 510 to the induced voltage determiner 512 and the driving voltages Vα and Vβ supplied from the coordinate inverse transformer 505 to the induced voltage determiner 512 according to Equations (7) and (8):

$$E\alpha = V\alpha - R * i\alpha - L * di\alpha/dt \quad (7)$$

$$E\beta = V\beta - R * i\beta - L * di\beta/dt \quad (8)$$

In Equations (7) and (8), R denotes winding resistance and L denotes winding inductance. The values of R and L are specific to the motor 509 that is used and are stored in advance in the ROM 151*b* or in a memory (not illustrated) provided in the motor control apparatus 157.

The induced voltages Eα and Eβ determined by the induced voltage determiner 512 are supplied to a phase determiner 513.

The phase determiner 513 determines the rotation phase θ of the rotor 402 of the motor 509 according to Equation (9) based on the ratio between the induced voltage Eα and the induced voltage Eβ, which are supplied from the induced voltage determiner 512.

$$\theta = \tan\hat{}-1(-E\beta/E\alpha) \quad (9)$$

Although the phase determiner 513 determines the rotation phase θ through the calculation according to Equation (9) in the first embodiment, the determination of the rotation phase θ is not limited to this. For example, the phase determiner 513 may determine the rotation phase θ by referring to a table indicating the relationship between the induced voltage Eα and the induced voltage Eβ and the rotation phase θ corresponding to the induced voltage Eα and the induced voltage Eβ, which is stored in the ROM 151*b* or the like.

The rotation phase θ of the rotor 402 determined in the above manner is supplied to the subtractor 101, the coordinate inverse transformer 505, and the coordinate transformer 511.

The motor control apparatus 157 repeats the above control.

As described above, the motor control apparatus 157 in the first embodiment performs the vector control using the phase feedback control in which the current values in the rotating coordinate system are controlled so that the difference between the instruction phase θ_ref and the rotation phase θ is decreased. Performing the vector control inhibits the motor from being put into a step-out state and suppresses an increase in motor sound and an increase in power consumption, which are caused by excess torque. Performing the phase feedback control enables the rotation phase of the rotor to be controlled that the rotor has a desired rotation phase. Accordingly, application of the vector control using the phase feedback control to the motor that drives a load (for example, the registration rollers) required to accurately control the rotation phase of the rotor in the image forming apparatus enables the image formation on the recording medium to be appropriately performed.

[Skew Correction]

Figure 5:
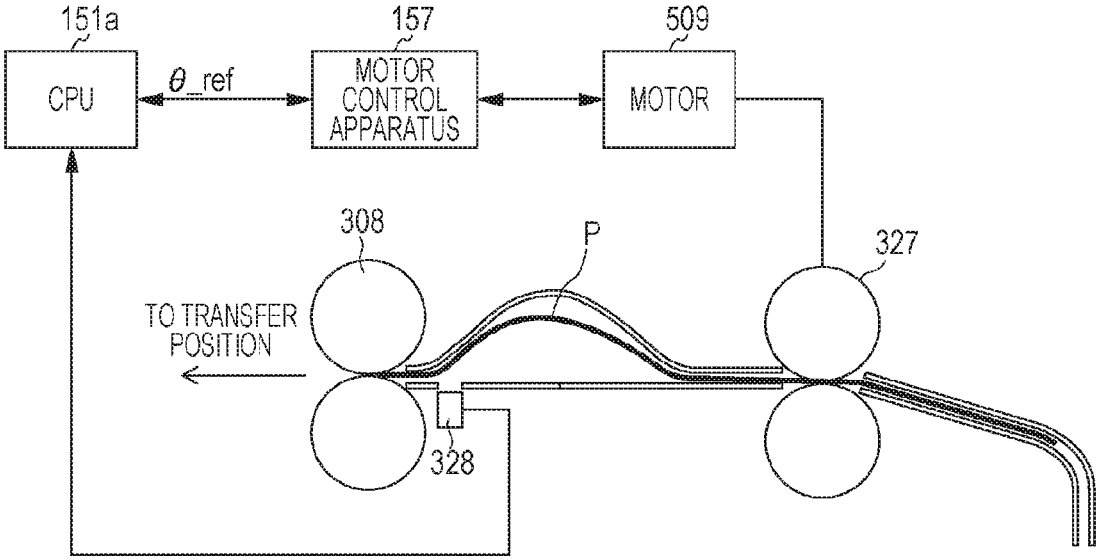
FIG. 5 is a diagram for describing how to correct skew on a side at the leading end side of a recording medium using registration rollers and pre-registration rollers.

FIG. 5 is a diagram for describing how the registration rollers 308 and the pre-registration rollers 327 correct the skew of the recording medium. A method of correcting the skew of the recording medium by the registration rollers 308 and the pre-registration rollers 327 will now be described with reference to FIG. 5. The pre-registration rollers 327 is provided at the upstream side of the registration rollers 308 in a direction in which a recording medium P is conveyed (such a direction is hereinafter referred to as a conveying direction). In addition, the sheet sensor 328 that detects the leading end of the recording medium P is provided at the upstream side of the registration rollers 308 and the downstream side of the pre-registration rollers 327 in the direction in which the recording medium P is conveyed.

The skew of the recording medium. P is corrected by the registration rollers 308 and the pre-registration rollers 327. Specifically, rotation of the pre-registration rollers 327 conveys the recording medium P in the conveying direction and the leading end of the recording medium P abuts against the nip portion of the registration rollers 308 that has stopped. Further rotation of the pre-registration rollers 327 conveys the recording medium P in the conveying direction. As a result, the recording medium P deflects and elastic force is applied on the recording medium P. The application of the elastic force on the recording medium P causes the leading end of the recording medium P to abut against the nip portion of the registration rollers 308. As a result, the skew of the recording medium. P is corrected. It is assumed in the process described above that the pre-registration rollers 327 rotate for a predetermined time after the sheet sensor 328 has detected the leading end of the recording medium P.

In the skew correction of the recording medium in related art, the pre-registration rollers 327 rotate for a predetermined time after the sheet sensor 328 has detected the leading end of the recording medium to deflect the recording medium, as described above. However, the pre-registration rollers 327 may deteriorate due to, for example, abrasion or stain with aging of the image forming apparatus. Accordingly, the amount of the feed of the recording medium by the pre-registration rollers 327 may be made smaller than that before the deterioration of the pre-registration rollers 327. In this case, even if the recording medium deflects because of the rotation of the pre-registration rollers 327 for a predetermined time after the sheet sensor 328 has detected the leading end of the recording medium, the amount of deflection of the recording medium may be insufficient for appropriate skew correction of the recording medium. In other words, the skew correction of the recording medium may not be appropriately performed.

Accordingly, the skew correction of the recording medium is performed using the following configuration in the first embodiment.

In the first embodiment, the motor control apparatus 157 is applied to control the motor that drives the pre-registration rollers 327.

As illustrated in FIG. 4, the current value iq generated by the coordinate conversion by the coordinate transformer 511 is supplied to the torque determiner 519. The torque determiner 519 determines a load torque value Tm exerted on the rotor 402 of the motor 509 based on the current value iq supplied from the coordinate transformer 511. Specifically, the torque determiner 519 determines the load torque value Tm according to Equation (10):

$$Tm=iq*kt \tag{10}$$

In Equation (10), kt denotes a proportionality factor indicating the relationship between the load torque value Tm and the current value iq and is specific to the motor.

The torque determiner 519 supplies the determined load torque value Tm to the CPU 151*a*.

Figure 6:
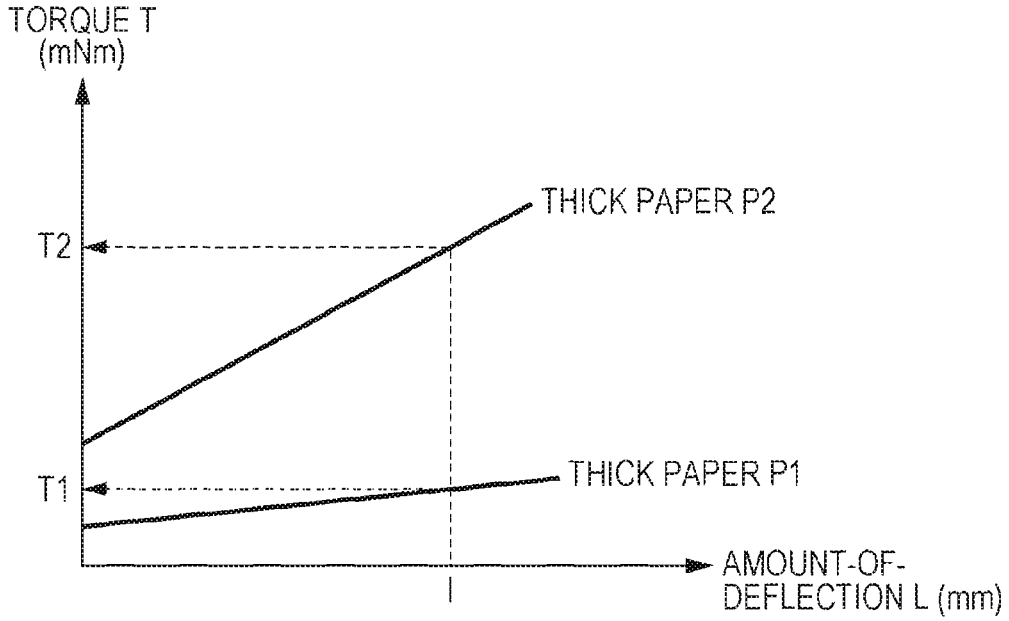
FIG. 6 is a graph indicating the relationship between a load torque value exerted on a rotor of a motor, which drives the pre-registration rollers, when the recording medium deflects and an amount of deflection of the recording medium for each sheet type.

FIG. 6 is a graph indicating the relationship between a load torque value T exerted on the rotor of the motor, which drives the pre-registration rollers, when the recording medium deflects and an amount-of-deflection L of the recording medium for each sheet type. The relationship between the load torque value T and the amount-of-deflection L illustrated in FIG. 6 is stored in, for example, the ROM 151*b*. The relationship between the load torque value T and the amount-of-deflection L illustrated in FIG. 6 is an example in the first embodiment, and the relationship is not limited to the one illustrated in FIG. 6.

The CPU 151*a* sets a value T1 or T2 as a threshold value Tth of the torque corresponding to an amount-of-deflection 1 at which the skew correction of the recording medium is appropriately performed based on the sheet type set by the user and the relationship between the load torque value T and the amount-of-deflection L.

In addition, the CPU 151*a* compares the threshold value Tth with the load torque value Tm determined by the torque determiner 519. A case in which the sheet type set by the user is thick paper P1, that is, a case in which the threshold value Tth has a value of T1 will now be described.

If the load torque value Tm determined by the torque determiner 519 is smaller than the threshold value T1 (Tm<T1), the CPU 151*a* controls the motor control apparatus 157 so that the driving of the motor 509 is continued.

If the load torque value Tm determined by the torque determiner 519 is greater than or equal to the threshold value T1 (Tm≥T1), the CPU 151*a* controls the motor control apparatus 157 so that the driving of the motor 509 is stopped.

Figure 7:
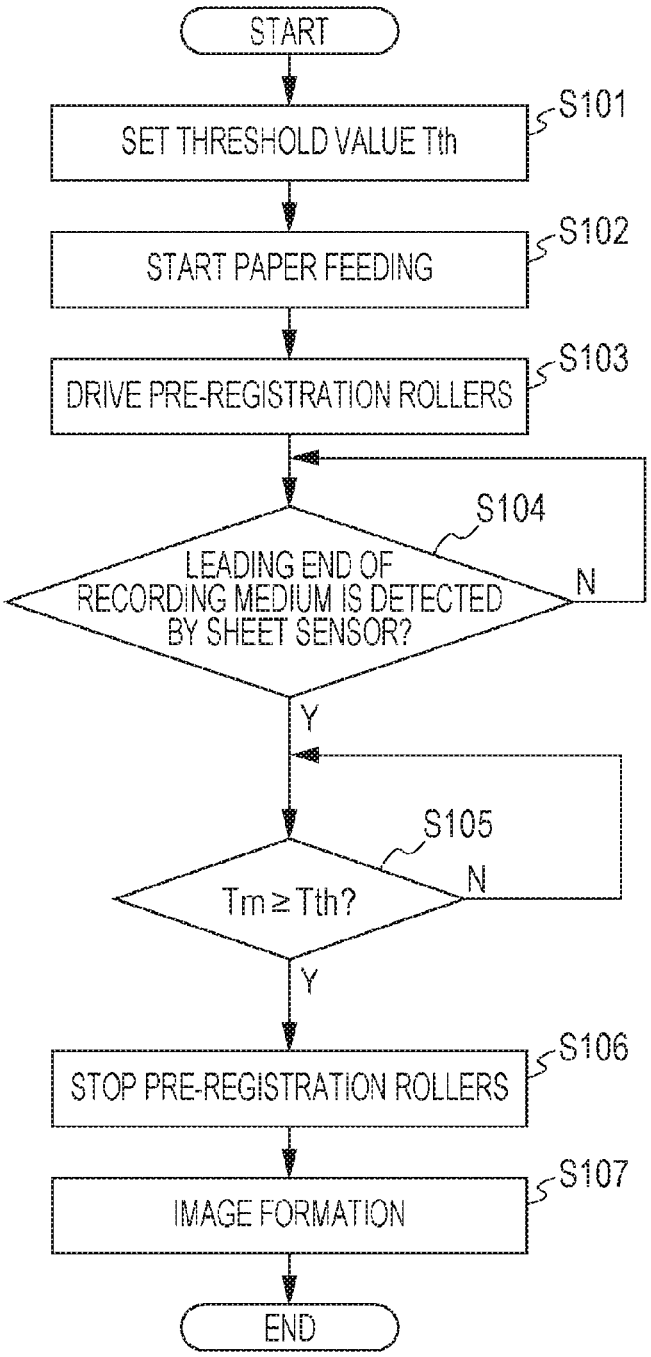
FIG. 7 is a flowchart illustrating a method of correcting the skew of the recording medium.

FIG. 7 is a flowchart illustrating a method of correcting the skew of the recording medium. How to correct the skew of the recording medium in the first embodiment will now be described with reference to FIG. 7. The process in the flowchart is performed by the CPU 151*a*.

Referring to FIG. 7, in Step S101, the CPU 151*a* sets the threshold value Tth based on information about the sheet type received from the operation unit 152.

In Step S102, the CPU 151*a* (the system controller 151) starts an operational sequence of the image forming apparatus 100, such as the feeding of the recording medium.

In Step S103, the CPU 151*a* supplies an enable signal 'H' to the motor control apparatus 157 and the motor control apparatus 157 controls the driving of the motor 509, which drives the pre-registration rollers 327. The enable signal is a signal to permit or inhibit the activation of the motor control apparatus 157. If the enable signal is set to an 'L (low level)', the CPU 151*a* inhibits the activation of the motor control apparatus 157. In other words, the control of the motor 509 by the motor control apparatus 157 is terminated. If the enable signal is set to a 'H (high level)', the CPU 151*a* permits the activation of the motor control apparatus 157 and the motor control apparatus 157 controls the motor 509 based on an instruction supplied from the CPU 151*a*.

In Step S104, the CPU 151*a* determines whether the leading end of the recording' medium is detected by the sheet sensor 328. If the leading end of the recording medium is detected by the sheet sensor 328 (YES in Step S104), the process goes to Step S105.

In Step S105, the CPU 151*a* determines whether the load torque value Tm exerted on the rotor 402 of the motor 509 is higher than or equal to the threshold value Tth. If the load torque value Tm exerted on the rotor 402 of the motor 509 is higher than or equal to the threshold value Tth (YES in Step S105), the process goes to Step S106. In Step S106, the CPU 151*a* supplies the enable signal 'L' to the motor control apparatus 157. As a result, the motor control apparatus 157 stops the rotation of the motor 509, which drives the pre-registration rollers 327. Then, the process goes to Step S107.

In Step S107, the CPU 151*a* (the system controller 151) controls the operational sequence of the image forming apparatus 100 so that the registration rollers 308 feed the recording medium to the transfer position in time with the toner image. As a result, the image forming apparatus 100 forms an image on the recording medium.

The skew correction of the recording medium is performed in the above manner in the first embodiment. Also in a case in which the sheet type set by the user is thick paper P2, that is, also in a case in which the threshold value Tth has a value of T2, the CPU 151*a* performs the control in the same manner.

As described above, the amount of deflection of the recording medium is controlled based on the current value iq in the first embodiment. Specifically, if the load torque value Tm exerted on the rotor 402, which is based on the current value iq, is lower than the threshold value Tth, the CPU 151*a* controls the motor control apparatus 157 so that the driving of the motor 509 is continued. If the load torque value Tm is higher than or equal to the threshold value Tth, the CPU 151*a* controls the motor control apparatus 157 so that the driving of the motor 509 is stopped. In other words, the CPU 151*a* rotates the pre-registration rollers 327, until the load torque value Tm exerted on the rotor 402 has a value corresponding to the amount-of-deflection 1 at which the skew correction of the recording medium is appropriately performed, to deflect the recording medium. As a result, the recording medium deflects by the amount in which the skew correction of the recording medium is appropriately performed even if the pre-registration rollers 327 deteriorates and the amount of the feed of the recording medium by the pre-registration rollers 327 is made smaller than that before the deterioration of the pre-registration rollers 327. Accordingly, the skew correction of the recording medium is appropriately performed. In addition, since the CPU 151*a* controls the motor control apparatus 157 so that the pre-registration rollers 327 is stopped if the load torque value Tm is higher than or equal to the threshold value Tth, the amount of deflection of the recording medium is inhibited from being excessively increased. As a result, it is possible to suppress protrusion of the leading end of the recording medium from the nip portion of the registration rollers 308, which is caused by an increase in the elastic force applied on the recording medium due to the excessive increase in the amount of deflection of the recording medium, and to suppress the step-out state of the motor 509, which is caused by an increase in the load torque exerted on the rotor 402. In addition, it is possible to suppress bending of the recording medium, which is caused by the excessive increase in the amount of deflection of the recording medium.

Second Embodiment

The configuration of an image forming apparatus according to a second embodiment is the same as that of the image forming apparatus according to the first embodiment. A description of the configuration of the motor control apparatus 157 and the configuration to correct the skew of the recording medium, which are the same as those in the first embodiment, is omitted herein.

As described above in the first embodiment, the elastic force is applied on the recording medium when the recording medium deflects. In other words, in addition to the force in the conveying direction, force in the opposite direction is applied on the recording medium. As a result, even when the pre-registration rollers 327 rotate, the pre-registration rollers 327 may slip and the recording medium may not be fed in the conveying direction. In this case, the recording medium may not deflect by an appropriate amount even when the pre-registration rollers 327 rotate and the power consumption may be increased due to unnecessary driving of the motor 509.

An exemplary operation of the image forming apparatus 100 when the pre-registration rollers 327 slip will now be described. In the second embodiment, the CPU 151*a* determines whether a predetermined time elapses after the sheet sensor 328 has detected the leading end of the recording medium. The predetermined time is set to a time period sufficiently longer than the time necessary for the recording medium to deflect by an appropriate amount of deflection.

If the load torque value Tm determined by the torque determiner 519 is lower than the threshold value Tth despite the fact that the predetermined time elapses since the sheet sensor 328 has detected the leading end of the recording medium, the pre-registration rollers 327 may slip. In this case, the recording medium may not deflect by an appropriate amount of deflection. Accordingly, if the load torque value Tm is lower than the threshold value Tth when the predetermined time elapses since the sheet sensor 328 has detected the leading end of the recording medium, the CPU 151*a* controls the motor control apparatus 157 so that the driving of the motor 509 is stopped. Specifically, the CPU 151*a* supplies the enable signal to the motor control apparatus 157 and the motor control apparatus 157 stops the control of the motor 509. In addition, the CPU 151*a* transmits information indicating that the pre-registration rollers 327 fail to the operation unit 152. The operation unit 152 displays the received information in the display.

Figure 8:
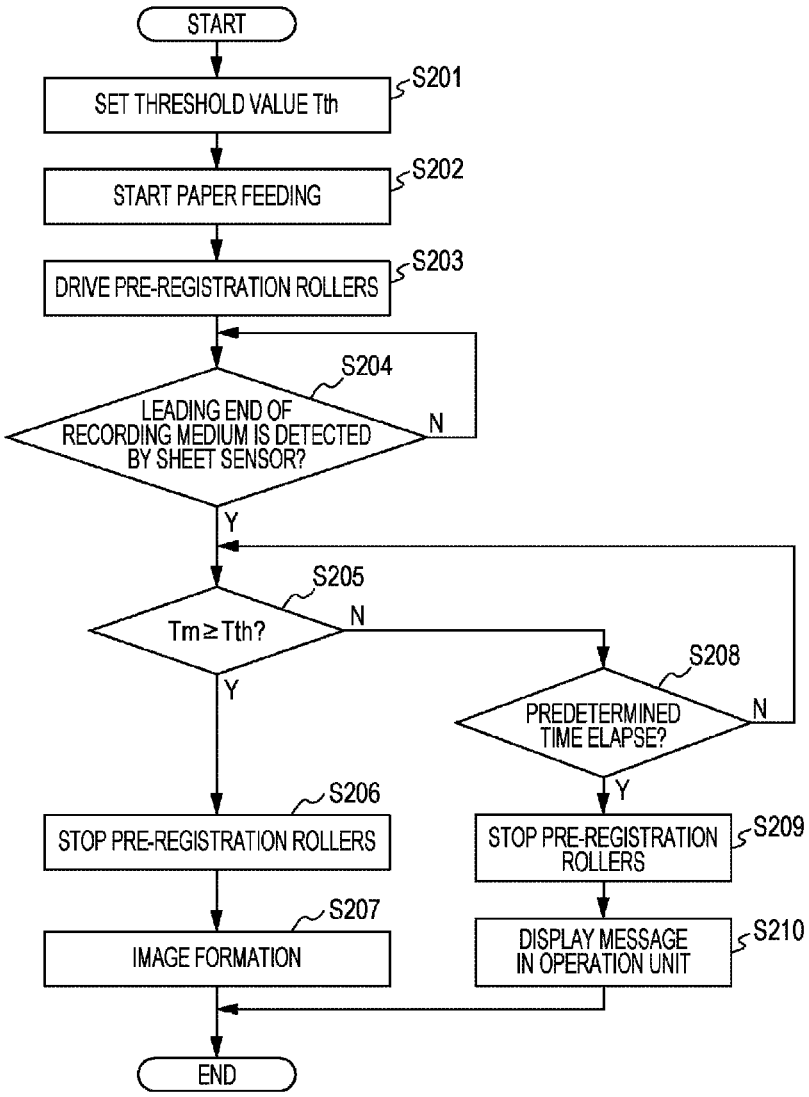
FIG. 8 is a flowchart illustrating a method of correcting the skew of the recording medium in a second embodiment.

FIG. 8 is a flowchart illustrating a method of correcting the skew of the recording medium in the second embodiment. The process in the flowchart is performed by the CPU 151*a*.

Referring to FIG. 8, in Step S201, the CPU 151*a* sets the threshold value Tth based on information about the sheet type received from the operation unit 152.

In Step S202, the CPU 151*a* (the system controller 151) starts an operational sequence of the image forming apparatus 100, such as the feeding of the recording medium.

In Step S203, the CPU 151*a* supplies the enable signal 'H' to the motor control apparatus 157 and the motor control apparatus 157 controls the driving of the motor 509, which drives the pre-registration rollers 327.

In Step S204, the CPU 151*a* determines whether the leading end of the recording medium is detected by the sheet sensor 328. If the leading end of the recording medium is detected by the sheet sensor 328 (YES in Step S204), the process goes to Step S205.

In Step S205, the CPU 151*a* determines whether the load torque value Tm exerted on the rotor 402 of the motor 509 is higher than or equal to the threshold value Tth. If the load torque value Tm exerted on the rotor 402 of the motor 509 is higher than or equal to the threshold value Tth (YES in Step S205), the process goes to Step S206. In Step S206, the CPU 151*a* supplies the enable signal 'L' to the motor control apparatus 157. As a result, the motor control apparatus 157 stops the rotation of the motor 509, which drives the pre-registration rollers 327. Then, the process goes to Step S207.

In Step S207, the CPU 151*a* (the system controller 151) controls the operational sequence of the image forming apparatus 100 so that the registration rollers 308 feed the recording medium to the transfer position in time with the toner image. As a result, the image forming apparatus 100 forms an image on the recording medium.

If the load torque value Tm exerted on the rotor 402 of the motor 509 is lower than the threshold value Tth (NO in Step S205), the process goes to Step S208.

In Step S208, the CPU 151*a* determines whether a predetermined time elapses since the sheet sensor 328 has detected the leading end of the recording medium. If a predetermined time do not elapse since the sheet sensor 328 has detected the leading end of the recording medium (NO in Step S208), the process goes back to Step S205.

If a predetermined time elapses since the sheet sensor 328 has detected the leading end of the recording medium (YES in Step S208), the process goes to Step S209. In Step S209, the CPU 151*a* supplies the enable signal 'L' to the motor control apparatus 157 and the motor control apparatus 157 stops the rotation of the motor 509, which drives the pre-registration rollers 327.

In Step S210, the CPU 151*a* (the system controller 151) transmits information indicating that the pre-registration rollers 327 fail to the operation unit 152. The operation unit 152 displays the received information in the display.

The skew correction of the recording medium is performed in the above manner in the second embodiment. As described above, if the load torque value Tm is lower than the threshold value Tth despite the fact that a predetermined time elapses since the sheet sensor 328 has detected the leading end of the recording medium, the CPU 151*a* controls the motor control apparatus 157 so that the driving of the motor 509 is stopped. As a result, it is possible to suppress an increase in the power consumption, which is caused by unnecessary driving of the motor 509. In addition, the operation unit 152 displays the information indicating that the pre-registration rollers 327 fail in the display to indicate to the user that the pre-registration rollers 327 fail. As a result, it is possible to inhibit the pre-registration rollers 327 from feeding the recording medium in a state in which the pre-registration rollers 327 fail.

Although the CPU 151*a* causes the recording medium to deflect based on the result of the comparison between the load torque value Tm exerted on the rotor 402 with the threshold value Tth in the first and second embodiments, the control by the CPU 151*a* is not limited to this. For example, the CPU 151*a* may cause the recording medium to deflect based on the current value iq. For example, the following configuration may be adopted. Specifically, the CPU 151*a* may set a threshold value iqth corresponding to the appropriate amount-of-deflection 1 based on the sheet type set by the user and the relationship between the current value iq and the amount-of-deflection L, which is stored in advance in the ROM 151*b*. If the current value iq supplied from the coordinate transformer 511 is lower than the threshold value iqth, the CPU 151*a* may control the motor control apparatus 157 so that the rotation of the pre-registration rollers 327 is kept. If the current value iq supplied from the coordinate transformer 511 is higher than or equal to the threshold value iqth, the CPU 151*a* may control the motor control apparatus 157 so that the rotation of the pre-registration rollers 327 is stopped.

Although the torque determiner 519 determines the load torque value Tm according to Equation (10) in the first and second embodiments, the determination of the load torque value Tm is not limited to this. For example, the load torque value Tm may be determined based on the difference between the rotation phase θ and the instruction phase θ_ref. Alternatively, a table indicating the relationship between the load torque value Tm and the current value iq may be stored in advance in the ROM 151*b* and the load torque value Tm corresponding to the current value iq may be determined based on the table.

Although the torque determiner 519 determines the load torque value Tm exerted on the rotor 402 of the motor 509 in the first and second embodiments, the determination of the load torque value Tm is not limited to this. For example, the CPU 151*a* may determine the load torque value Tm.

Although the skew of the recording medium is corrected by causing the leading end of the recording medium to abut against the nip portion of the registration rollers 308 in the first and second embodiments, the skew correction of the recording medium is not limited to this. For example, a configuration may be adopted in which the skew of the recording medium is corrected by causing the leading end of the recording medium to abut against a shutter, which is the abutment member, and the shutter escapes when the registration rollers 308 convey the recording medium to the transfer position in time with the toner image. The shutter is provided at the upstream side of the registration rollers 308 and at the downstream side of the sheet sensor 328 in the conveying direction of the recording medium or is provided at the upstream side of the transfer position and at the downstream side of the registration rollers 308 in the conveying direction of the recording medium.

Although the stepping motor is used as the motor that drives the load in the first and second embodiments, another motor, such as a direct-current (DC) motor, may be used. The motor is not limited to the two-phase motor and may be another motor, such as a three-phase motor.

Although the motor control apparatus 157 stops the motor 509, which drives the pre-registration rollers 327, in response to the enable signal 'L' supplied from the CPU 151*a* to the motor control apparatus 157 in the first and second embodiments, the stop of the motor 509 is not limited to this. For example, a configuration may be adopted in which the CPU 151*a* supplies the enable signal 'H', instead of the enable signal 'L', to the motor control apparatus 157, the CPU 151*a* supplies the same instruction phase as the instruction phase that has been previously output to the motor control apparatus 157 as the instruction phase θ_ref, and the CPU 151*a* continues to supply the same instruction phase to the motor control apparatus 157. In this case, the motor control apparatus 157 is capable of fixing the rotation phase of the rotor 402. In other words, the motor control apparatus 157 is capable of stopping the rotation of the pre-registration rollers 327.

Although the skew correction of the recording medium in the main body 301 of the image forming apparatus is described in the first and second embodiments, the first and second embodiments may be applied to, for example, skew correction of an original document in a document reading apparatus.

According to the present disclosure, even if the conveying rollers deteriorate in the control of the motor based on the load torque exerted on the rotor of the motor, which drives the conveying rollers, in a state in which the leading end of a sheet abuts against the abutment member to deflect the sheet, the skew correction of the recording medium is appropriately performed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application. No. 2016-078268 filed. Apr. 8, 2016, which is hereby incorporated by reference herein in its entirety.

What is claimed is:

1. A sheet conveying apparatus comprising:

a conveying roller configured to convey a sheet;

an abutment member against which a leading end of the sheet conveyed by the conveying roller abuts, the abutment member being provided at a downstream side of the conveying roller in a conveying direction in which the sheet is conveyed;

a motor configured to drive the conveying roller;

a phase determiner configured to determine a rotation phase of a rotor of the motor;

a controller configured to control the motor by controlling a value of a torque current component and a value of an excitation current component so that a difference between an instruction phase representing a target phase of the rotor and the rotation phase determined by the phase determiner is decreased, the torque current component being a current component having a current value represented in a rotating coordinate system based on the rotation phase, which generates torque in the rotor, and the excitation current component being a current component having a current value represented in the rotating coordinate system based on the rotation phase, which affects a strength of a magnetic flux through a winding of the motor; and a torque determiner configured to determine load torque exerted on the rotor, wherein the controller continues driving of the motor if the load torque determined by the torque determiner is lower than predetermined torque when the conveying roller conveys the sheet in a state in which the leading end of the sheet abuts against the abutment member to deflect the sheet and stops the driving of the motor if the load torque determined by the torque determiner is higher than or equal to the predetermined torque when the conveying roller conveys the sheet in a state in which the leading end of the sheet abuts against the abutment member to deflect the sheet.

2. The sheet conveying apparatus according to claim 1, wherein the abutment member is a second conveying roller that conveys the sheet in a deflected state, and wherein the controller controls the driving of the motor so that the conveying roller conveys the sheet in a state in which the leading end of the sheet abuts against the second conveying roller in a stopped state to deflect the sheet.

3. The sheet conveying apparatus according to claim 2, wherein the torque determiner determines the load torque based on the value of the torque current component.

4. The sheet conveying apparatus according to claim 3, wherein the predetermined torque is torque corresponding to a type of the sheet.

5. The sheet conveying apparatus according to claim 4, wherein the controller includes a current provider that supplies current to the winding of a first phase of the motor and current to the winding of a second phase thereof, a current detector that detects a current value of the current supplied to the winding of the first phase of the motor by the current provider and a current value of the current supplied to the winding of the second phase thereof by the current provider, a generator that generates driving voltage to drive the current provider, and an induced voltage determiner that determines a magnitude of induced voltage induced in the winding of the first phase and a magnitude of induced voltage induced in the winding of the second phase in response to rotation of the rotor of the motor based on the driving voltage generated by the generator and the current values detected by the current detector, and wherein the phase determiner determines the rotation phase of the rotor of the motor based on the magnitude of the induced voltage of the first phase and the magnitude of the induced voltage of the second phase, which are determined by the induced voltage determiner.

6. The sheet conveying apparatus according to claim 5, wherein the controller controls the value of the excitation current component so as to be zero and controls the value of the torque current component to control the motor.

7. A sheet conveying apparatus comprising:

a conveying roller configured to convey a sheet;

an abutment member against which a leading end of the sheet conveyed by the conveying roller abuts, the abutment member being provided at a downstream side of the conveying roller in a conveying direction in which the sheet is conveyed;

a motor configured to drive the conveying roller;

a phase determiner configured to determine a rotation phase of a rotor of the motor; and a controller configured to control the motor by controlling a value of a torque current component and a value of an excitation current component so that a difference between an instruction phase representing a target phase of the rotor and the rotation phase determined by the phase determiner is decreased, the torque current component being a current component having a current value represented in a rotating coordinate system based on the rotation phase, which generates torque in the rotor, and the excitation current component being a current component having a current value represented in the rotating coordinate system based on the rotation phase, which affects a strength of a magnetic flux through a winding of the motor, wherein the controller continues driving of the motor if the value of the torque current component is lower than a predetermined value when the conveying roller conveys the sheet in a state in which the leading end of the sheet abuts against the abutment member to deflect the sheet and stops the driving of the motor if the value of the torque current component is higher than or equal to the predetermined value when the conveying roller conveys the sheet in a state in which the leading end of the sheet abuts against the abutment member to deflect the sheet.

8. The sheet conveying apparatus according to claim 7, wherein the abutment member is a second conveying roller that conveys the sheet in a deflected state, and wherein the controller controls the driving of the motor so that the conveying roller conveys the sheet in a state in which the leading end of the sheet abuts against the second conveying roller in a stopped state to deflect the sheet.

9. The sheet conveying apparatus according to claim 8, wherein the predetermined value is a value corresponding to a type of the sheet.

10. A document reading apparatus comprising:

a document tray in which an original document is stacked;

a conveying roller configured to convey the original document stacked in the document tray;

a reading unit configured to read the original document conveyed by the conveying roller;

an abutment member against which a leading end of a sheet conveyed by the conveying roller abuts, the abutment member being provided at a downstream side of the conveying roller and at an upstream side of the reading unit in a conveying direction in which the sheet is conveyed;

a motor configured to drive the conveying roller;

a phase determiner configured to determine a rotation phase of a rotor of the motor;

a controller configured to control the motor by controlling a value of a torque current component and a value of an excitation current component so that a difference between an instruction phase representing a target phase of the rotor and the rotation phase determined by the phase determiner is decreased, the torque current component being a current component having a current value represented in a rotating coordinate system based on the rotation phase, which generates torque in the rotor, and the excitation current component being a current component having a current value represented in the rotating coordinate system based on the rotation phase, which affects a strength of a magnetic flux through a winding of the motor; and a torque determiner configured to determine load torque exerted on the rotor, wherein the controller continues driving of the motor if the load torque determined by the torque determiner is lower than predetermined torque when the conveying roller conveys the sheet in a state in which the leading end of the sheet abuts against the abutment member to deflect the sheet and stops the driving of the motor if the load torque determined by the torque determiner is higher than or equal to the predetermined torque when the conveying roller conveys the sheet in a state in which the leading end of the sheet abuts against the abutment member to deflect the sheet.

11. An image forming apparatus comprising:

a conveying roller configured to convey a recording medium;

an image forming unit configured to form an image on the recording medium conveyed by the conveying' roller;

an abutment member against which a leading end of a sheet conveyed by the conveying roller abuts, the abutment member being provided at a downstream side of the conveying roller in a conveying direction in which the sheet is conveyed;

a motor configured to drive the conveying roller;

a phase determiner configured to determine a rotation phase of a rotor of the motor;

a controller configured to control the motor by controlling a value of a torque current component and a value of an excitation current component so that a difference between an instruction phase representing a target phase of the rotor and the rotation phase determined by the phase determiner is decreased, the torque current component being a current component having a current value represented in a rotating coordinate system based on the rotation phase, which generates torque in the rotor, and the excitation current component being a current component having a current value represented in the rotating coordinate system based on the rotation phase, which affects a strength of a magnetic flux through a winding of the motor; and a torque determiner configured to determine load torque exerted on the rotor, wherein the controller continues driving of the motor if the load torque determined by the torque determiner is lower than predetermined torque when the conveying roller conveys the sheet in a state in which the leading end of the sheet abuts against the abutment member to deflect the sheet and stops the driving of the motor if the load torque determined by the torque determiner is higher than or equal to the predetermined torque when the conveying roller conveys the sheet in a state in which the leading end of the sheet abuts against the abutment member to deflect the sheet.

* * * * *